US008269685B2

(12) United States Patent
McQuaid et al.

(10) Patent No.: US 8,269,685 B2
(45) **Date of Patent: *Sep. 18, 2012**

(54) TAPERED SLOT ANTENNA

(75) Inventors: Matthew M. McQuaid, Hudson, NH (US); Michael J. O'Brien, Nashau, NH (US); Nicolas S. Peterson, Merrimack, NH (US); Basil W. Thompson, Hooksett, NH (US); Duane A. Beaulieu, Brookline, NH (US); Kari M. Karwedsky, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 328 days.

This patent is subject to a terminal disclaimer.

(21) Appl. No.: 12/776,005

(22) Filed: May 7, 2010

(65) Prior Publication Data

US 2011/0273350 A1 Nov. 10, 2011

(51) Int. Cl.
*H01Q 13/10* (2006.01)

(52) U.S. Cl. ..... 343/767; 343/700 MS

(58) Field of Classification Search ..... 343/700 MS, 343/767

See application file for complete search history.

(56) References Cited

U.S. PATENT DOCUMENTS

| | | | | |
|---|---|---|---|---|
| 4,853,704 | A | 8/1989 | Diaz et al. | |
| 6,075,493 | A | 6/2000 | Sugawara et al. | |
| 6,111,475 | A * | 8/2000 | Giugni | 333/103 |
| 6,642,898 | B2 * | 11/2003 | Eason | 343/770 |
| 6,850,203 | B1 * | 2/2005 | Schuneman et al. | 343/767 |
| 7,088,300 | B2 * | 8/2006 | Fisher | 343/767 |

* cited by examiner

*Primary Examiner* — Hoanganh Le
(74) *Attorney, Agent, or Firm* — Sand & Sebolt; Rodney E. Haven

(57) ABSTRACT

Methods, antennas and other embodiments associated with impedance matching an antenna feed slot. A slot antenna includes a planar metal sheet. A feed slot opening is formed in the metal sheet. The feed slot has a first end and a second end. A tapered opening is formed in the metal sheet. Adjacent sides of the tapered opening touch the first end of the feed slot. An impedance matching star shaped opening is formed in the metal. The impedance matching star shaped opening touches the second end of the feed slot.

21 Claims, 5 Drawing Sheets

TAPERED SLOT ANTENNA

STATEMENT OF GOVERNMENT INTEREST

The invention was made with United States Government support under Contract No. FA86290-06-G-4028-0008 awarded by the United States Air Force. The United States Government has certain rights in this invention.

BACKGROUND OF THE INVENTION

1. Technical Field

The present invention relates generally to apparatus and systems for transmitting and sending electromagnetic radiation. More particularly, the apparatus and systems relate to transmitting and sending electromagnetic radiation with antennas. Specifically, the apparatus and systems of the present invention involve a tapered slot antenna for transmitting and sending electromagnetic signals.

2. Background Information

Tapered slot antennas (TSAs) belong to the general class of end-fire travelling wave antennas and include a tapered slot etched onto a thin film of metal. A TSA can be very economically etched onto a printed circuit board (PCB) film with or without a dielectric substrate on one side of the film. TSAs can be formed on PCBs of mobile devices such as cellular telephones. Besides being efficient and lightweight, TSAs are often used because they can work over a large frequency bandwidth and produce a symmetrical end-fire beam with appreciable gain and low side lobes. TSAs also generally have wider bandwidth, higher directivity and are able to produce more symmetrical radiation patterns than other antennas such as horn antennas.

TSAs are a class of endfire antennas known as surface wave antennas. Several types of TSAs exist, the most common being linear-tapered slot antennas (LTSAs), Vivaldi-tapered slot antennas (VTSAs) and constant-width tapered slot antennas (CWTAs). The beam widths of CWSAs are typically the smallest, followed by LTSAs and VTSAs. The side lobe levels are typically the largest for VTSAs, followed by LTSAs and CWSAs.

A TSA is formed by slowly increasing the width of a slot from the point of its feed to an open end of width generally greater than $\lambda_O/2$, where $\lambda_O$ is the center frequency. The impedance, bandwidth and radiation patterns of the TSA are greatly affected by parameters such as length, width and taper profile of the TSA. The dielectric substrate's thickness and relative permittivity can also contribute to the efficiency of the antenna. While current TSA's provide good performance characteristics at relatively inexpensive costs, improvements can be made.

BRIEF SUMMARY OF THE INVENTION

The preferred embodiment of a slot antenna includes a planar conductor. A feed slot with a first end and a second end is formed in the planar conductor. A tapered slot and an impedance matching stub are also formed on adjacent sides of the feed slot in the planar conductor. The tapered slot pattern is formed beginning at the first end of the feed slot so that the tapered slot pattern is widened away from the first end. The impedance matching stub is formed in the planar conductor as a star pattern adjacent to the second end of the feed slot.

The star pattern of the impedance matching stub can include a plurality of star points arranged in an oval pattern. The star points can be spread out equal radial distances from each other in the oval pattern. The oval pattern may be a circle shape. Alternatively, a tip of two or more star points can lie on the oval pattern.

In the preferred embodiment, the star pattern is formed with sixteen star points (e.g., arms). Alternatively, the star pattern is formed with between 11 and 21 star points or another number of star points. In the preferred embodiment, tips of the star points are rounded. A tip of one of the star points touches the feed line. The star pattern can form an impedance matching stub configured to act as an open. Alternatively, the star pattern can be represented by a generally sinusoidal pattern formed into a circle.

In the preferred embodiment, the slot antenna is configured to be excited with a center conductor of a coaxial cable or a transmission line. The planar conductor can be a sheet of copper on a printed circuit board (PCB). The slot antenna can include a high dielectric sheet, with the copper deposited on the high dielectric sheet.

Another configuration of the preferred embodiment includes a method that creates a slot antenna by creating a slot, creating a tapered opening and creating a star shaped opening. The method creates a slot in a metal sheet with a first end and a second end. A tapered opening is created in the metal sheet beginning at the first end of the slot. The tapered opening increases from the first end to an outer edge of the metal sheet. A star shaped opening is created in the metal sheet adjacent the second end of the slot.

The method includes creating the star shaped opening so that the star shaped opening is configured to approximate an open circuit. The slot, tapered opening and star shaped opening can be created in a metal sheet that is deposited on a material of a printed circuit board (PCB).

BRIEF DESCRIPTION OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION OF THE INVENTION

Figure 1:
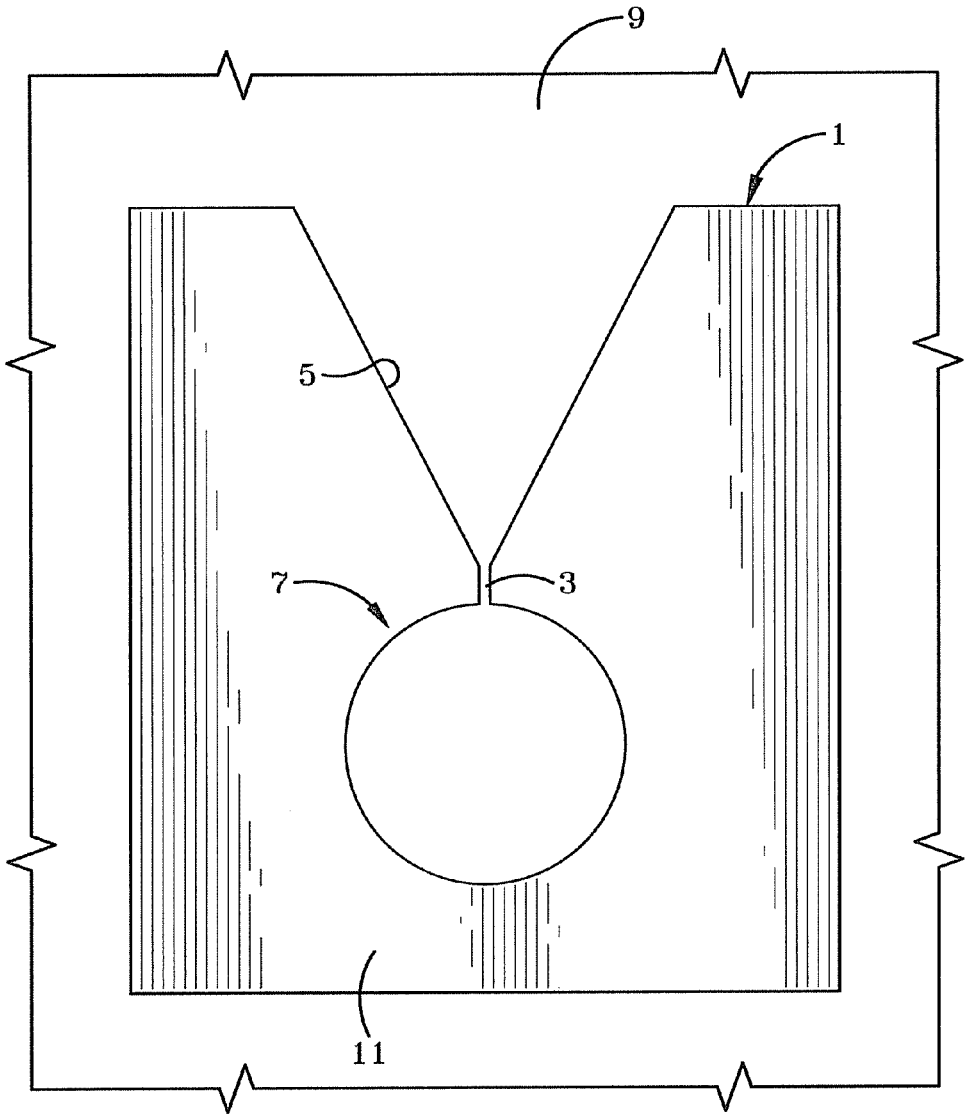
FIG-1 PRIOR ART
FIG. 1 illustrates a top view of a prior art tapered slot antenna with a circular impedance matching shape.

FIG. 1 illustrates a prior art tapered slot antenna (TSA) 1 fabricated on a printed circuit board (PCB) 9. A tapered slot antenna 1 is formed by creating a slot 3, a tapered opening 5, and an impedance matching shape 7 in a metal layer 11 that is deposited on a dielectric material. The impedance matching shape 7 is also called a stub termination that terminates the slot 3. In the traditional TSA 1, the slot 3 is adjacent (e.g., connected to) an impedance matching shape 7 (e.g., stub) in the shape of a circle that acts as an ideal open circuit.

Figure 2:
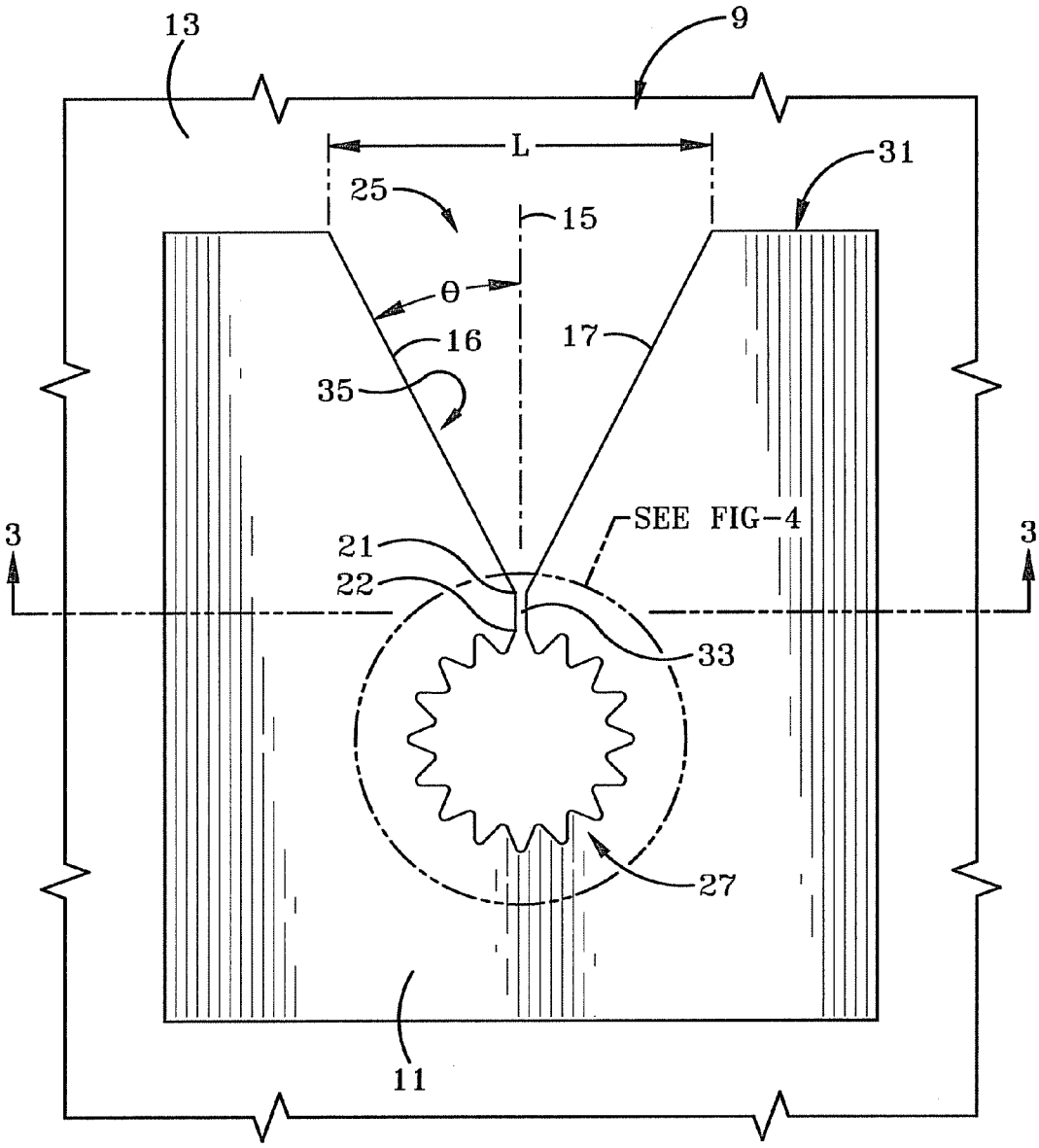
FIG. 2 illustrates a top view of the preferred embodiment of a tapered slot antenna with impedance matching shape in the form of a star.

FIG. 2 illustrates the preferred embodiment of a TSA 31. This TSA 31 can be fabricated on a PCB 9 similar to the prior art TSA of FIG. 1. The TSA 31 of the preferred embodiment also is formed with a slot 33, a tapered opening 25, and an impedance matching shape 27 in a metal layer 11 that is deposited on a dielectric material. The impedance matching shape 27 is also called a stub termination that terminates the slot 33. The impedance matching shape of the preferred embodiment is formed in the shape of a star rather than a circle.

Both the prior art impedance matching shapes 7 of a circle and the preferred embodiment impedance matching shape 27 of a star have a sufficient perimeter to match to an open circuit. The perimeter length of the preferred impedance matching shape 27 of FIG. 2 is similar to the perimeter length of the prior art impedance matching shape 7 shown in FIG. 1. Even though the perimeters are similar, the outside diameter of the star shape 27 of the preferred embodiment of FIG. 2 is significantly less than the outside diameter of the prior art circle shape of FIG. 1. The smaller diameter means that less PCB 9 area is needed to implement the preferred embodiment of the TSA 31 shown in FIG. 2 than the prior art TSA 1 shown in FIG. 1. This means either the PCB 9 of the preferred TSA 31 can be smaller or more circuits may be implemented on the PCB 9 with the preferred TSA 31 than with the prior art TSA 1 of FIG. 1. Using a star shaped stub can improve the TSA 31 performance at lower frequencies. Additionally, a star shaped stub provides a shunt resistance along the perimeter of the star shape to enable the stub to approximate an ideal open circuit over an extended bandwidth.

The tapered slot antenna 31 transmits a signal fed into the slot 33 or receives a signal received at the slot 33. As previously mentioned, the tapered opening 35 is formed by slowly increasing the width of the tapered opening 5 from a first end 21 of the slot 33 to an open end 25 of the tapered opening 35. It is generally desirable to have the length L of the open end 25 be greater than $\lambda_O/2$, where $\lambda_O$ is the center frequency of a signal the TSA 31 is to transmit. The impedance, bandwidth and radiation patterns of the TSA 31 are significantly affected by parameters such as length, width and taper profile of the TSA 31.

The tapered opening 35 may be other shapes than the tapered opening with straight sides 16, 17 shown in FIG. 2. The tapered opening 35 can have constant, linear and/or exponential tapers. For example, the tapered opening 35 can have sides 16, 17 that are curved as expressed by exponential or tangential functions. The TSA 31 can be a Vivaldi type of TSA with a corresponding Vivaldi shaped tapered opening 35. Alternatively, the tapered opening 35 can have sides 16, 17 that are made up of more than one straight line segment or a combination of straight line segments and curved line segments, and so on.

Figure 3:
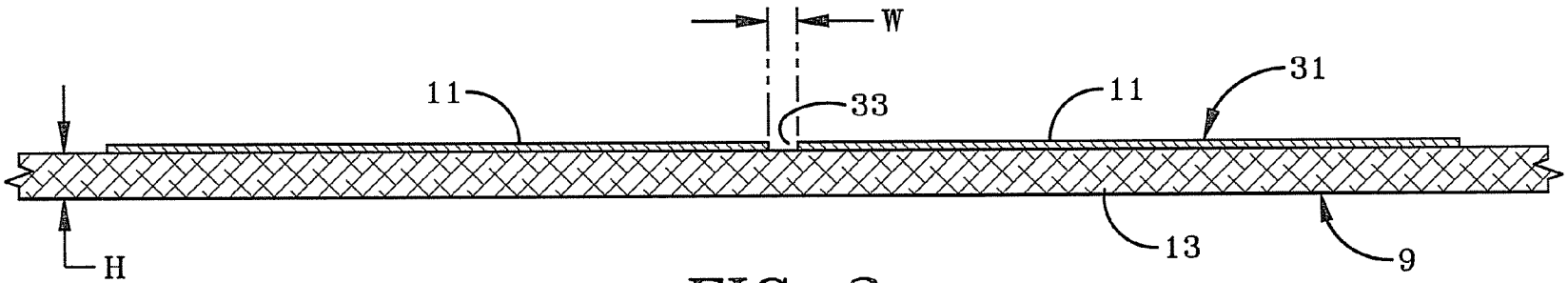
FIG. 3 illustrates a cross-sectional view taken on line 3-3 of FIG. 2 of the tapered slot antenna.

FIG. 3 shows a cross-sectional view of the slot 33 of the TSA 31. As shown in this figure, the metal layer 11 is deposited on top of dielectric material 13 that has a thickness H. The thickness of the dielectric material 13 and the relative permittivity of the dielectric material 13 can also contribute to the efficiency of the TSA 31.

The TSA 31 shown in FIG. 2 is capable of operating somewhere in a frequency bandwidth between of 50 MHz to 18 GHz. To achieve a wide bandwidth, an impedance matching shape 27 of a star is placed adjacent to the slot 33. This allows the tapered opening 35 to act as a transformer taking the 377 ohm free-space impedance down to 50 ohms.

In operation, the TSA 31 can be fed (e.g., excited) to transmit signals in different ways as understood by those of ordinary skill in the art, For example, the slot 33 can be excited using the center conductor of a coaxial cable 67 to feed the slot 33 a signal. Alternatively, a micro-strip line can feed the slot 33 by extending over the slot 33 by about a quarter of a wavelength. Alternatively, the slot 33 can be fed from a other feeds such as a coplanar waveguide (CPW), an air-bridge ground coplanar waveguide (GCPW), a finite coplanar waveguide (FCPW)/center-strip, a FCPW/notch as well as other types of feeds.

When the TSA 31 is fabricated on a PCB 9, the dielectric material 13 of the preferred embodiment is preferably a high dielectric constant. Thick dielectric substrates with low dielectric constants can also be used and may provide adequate efficiency and a wide bandwidth. However, using thick substrates with low dielectric constants will increase the area of the PCB 9 needed to fabricate the TSA 31 as compared to using a high dielectric material. In other embodiments, a variety of other dielectric constants with dielectric material 13 of different thicknesses can be used based on different design parameters.

Figure 4:
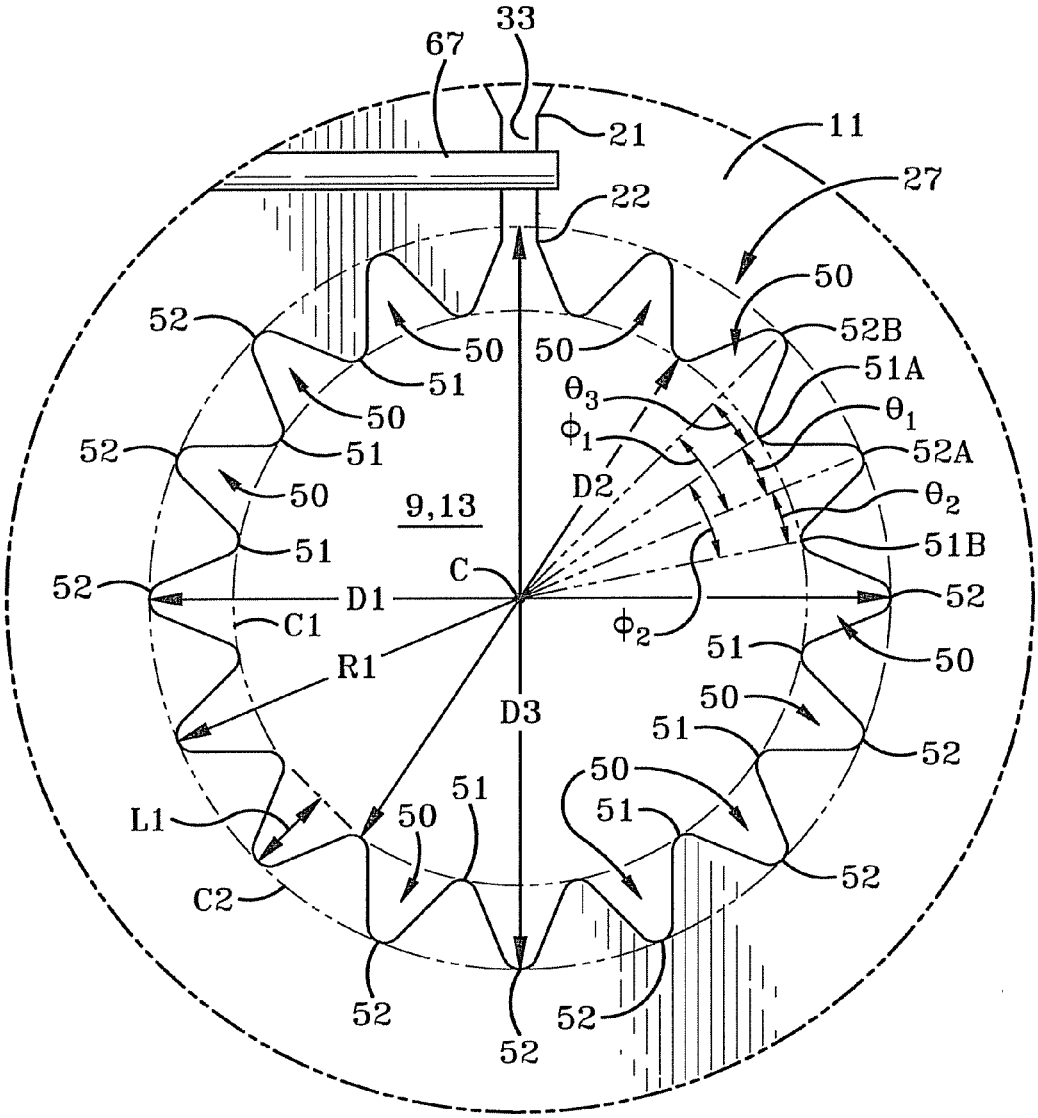
FIG. 4 illustrates an enlarged view of the encircled portion of FIG. 2.

The impedance matching shape 27 can be star shaped with star points 50 of the star arranged in an oval pattern impedance matching shape. For example, the diameters D1 and D2 shown in FIG. 4 are of similar lengths which results in the shape 27 that is circular as shown by circles C1 and C2. However, if diameters D1 and D2 have different lengths then the impedance matching shape 27 would be more elliptical. In the preferred embodiment, the star points 50 are spaced equal circumferential distances from each other in the circular pattern. The star points 50 may have rounded tips 52 and bases 51 between adjacent star points 50. As shown in FIG. 4, one of the star points 50 can be arranged to touch the second end 22 of the slot 33. The star tips 52 can lie on the circle C2 with a diameter D2 and the star bases 51 can lie on the smaller circle C1 with a diameter D1. Circles C1 and C2 are concentric with a common center in the preferred embodiment. In the preferred embodiment, the star shape will have about 16 star points and the a length from one of the bases 51 to a rounded tip 52 of a corresponding star point 52 has a length (L1) that is less than one half the radius R1 of the circle with Diameter D1. The star shaped impedance matching shape 27 can also resemble a sinusoidal waveform shape that has been bent into a circular shape.

As also shown in FIG. 4, in the preferred embodiment, the angle $\theta_1$ between one star tip 52A and an adjacent star base 51A on one side of the star tip 52A is similar to the angle $\theta_2$ between the same star tip 52A and the star base 51B on the other side of the star tip 52A. The angle $\theta_1$ between one star base 51A and an adjacent star tip 52A is similar to the angle $\theta_3$ between the same star base 51A and the star tip 52B on the other side of the star base 51A. Additionally, the angle $\phi_1$ between two adjacent start tips 52A, 52B is similar to the angel $\phi_2$ between two adjacent star bases 51A, 51B.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 5:
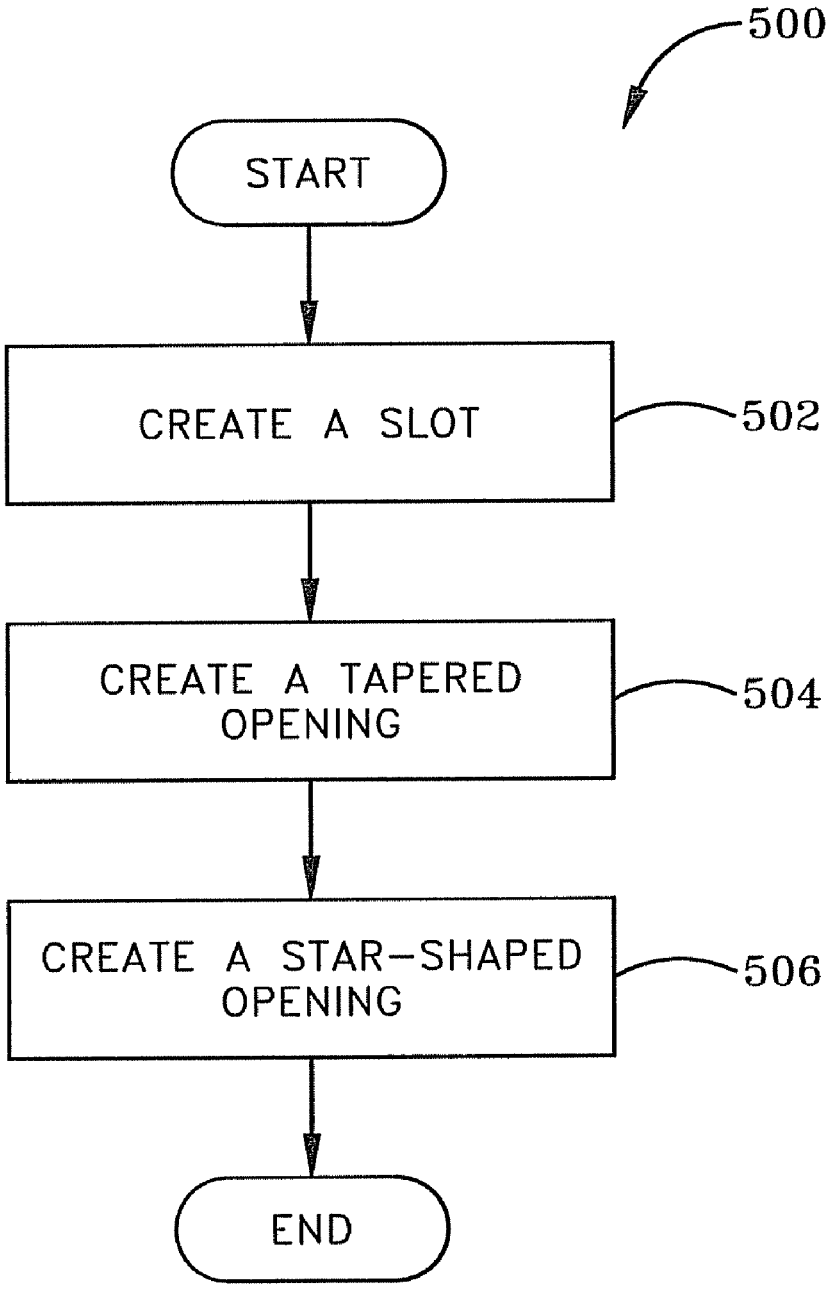
FIG. 5 illustrates a method of forming the tapered slot antenna of the preferred embodiment.

FIG. 5 illustrates a method 500 of fabricating a slot antenna. The method 500 creates a slot, at 502. The slot has a first end and a second end. The slot may be formed into a sheet of copper or other metal over a dielectric material on a printed circuit board (PCB). A tapered opening is created, at 504. The tapered opening is crated in the same metal sheet as the slot beginning at the first end of the slot. The tapered opening increases from the first end to an outer edge of the metal sheet. The tapered opening can be a linear tapered opening with straight sides. Alternatively, the sides can be curved or other shapes.

A star shaped opening is created, at 506, in same metal sheet as the slot and the tapered opening. The star shaped opening is configured to approximate an open circuit to impedance match the slot. The star shaped opening is formed adjacent the second end of the slot. The star shape can have about 16 arms with rounded tips.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. A slot antenna comprising:

a planar conductor forming a feed slot with a first end and a second end, a tapered slot pattern and an impedance matching opening;

wherein the tapered slot pattern is formed in the planar conductor beginning at the first end of the feed slot, wherein the tapered slot pattern is widened away from the first end; and wherein the impedance matching opening is formed in the planar conductor as a star pattern adjacent to the second end of the feed slot.

2. The slot antenna of claim 1 wherein the star pattern of the impedance matching opening further comprises:

a plurality of star points arranged in an oval pattern.

3. The slot antenna of claim 2 wherein plurality of the star points are spread out equal circumferential distances from each other in the oval pattern.

4. The slot antenna of claim 2 wherein the plurality of star points are arranged in a circle with a tip of two or more star points lying on the oval pattern.

5. The slot antenna of claim 2 wherein the plurality of star points are arranged in a circle with a tip of each star point lying on the circle.

6. The slot antenna of claim 2 wherein the plurality of star points comprises 12 to 20 star points.

7. The slot antenna of claim 2 wherein tips of the plurality of star points are rounded.

8. The slot antenna of claim 2 wherein a tip of one of the plurality of star points touches the feed slot.

9. The slot antenna of claim 1 wherein the impedance matching opening is configured to act as an open circuit.

10. The slot antenna of claim 1 wherein the star pattern is represented by a generally sinusoidal pattern formed into a circle.

11. The slot antenna of claim 1 wherein the slot antenna is configured to be excited with at least one of the group: a center conductor of a coaxial cable and a transmission line.

12. The slot antenna of claim 1 wherein the planar conductor is a sheet of copper on a printed circuit board (PCB).

13. The slot antenna of claim 12 further comprising:

a high dielectric sheet, wherein the copper is deposited on the high dielectric sheet.

14. A slot antenna comprising:

a planar metal sheet;

a feed slot opening formed in the metal sheet, wherein the feed slot opening is formed with a first end and a second end;

a tapered opening formed in the metal sheet, wherein the tapered opening is formed with adjacent sides touching the first end of the feed slot; and an impedance matching star shaped opening formed in the metal sheet, wherein the star shaped opening is formed touching the second end of the feed slot, wherein the star shaped opening is formed with star legs arranged in an oval pattern.

15. The slot antenna of claim 14 wherein the star legs comprise two or more bases with corresponding rounded points extending radially outward from a pair of corresponding bases, and wherein the star legs are about equally spaced circumferentially from each other around a circle.

16. The slot antenna of claim 15 wherein a first circle C1 is formed that passes through the star bases and a second circle C2 co-centric with C1 is formed that pass through the star points, wherein a radius R originates at the center of the second circle C2 and extends outward to the second circle C2, and wherein a length L1 of the radius R between the first circle Cl and the second circle C2 is less than one half the radius R.

17. The slot antenna of claim 14 wherein a tip of one of the star legs communicates with the feed slot.

18. The slot antenna of claim 14 wherein the adjacent sides are spaced further apart the further the adjacent sides are from the first end.

19. A method comprising:

creating a slot antenna by:

creating a slot in a metal sheet with a first end and a second end;

creating a tapered opening in the metal sheet beginning at the first end of the slot, wherein the tapered opening increases from the first end to an outer edge of the metal sheet; and creating a star shaped opening in the metal sheet adjacent the second end of the slot to impedance match the slot antenna.

20. The method of claim 19 further comprising:

creating the star shaped opening so that the star shaped opening is configured to approximate an open circuit.

21. The method of claim 19 further comprising:

creating the slot, the tapered opening and the star shaped opening in the metal sheet that is deposited on a dialect material of a printed circuit board (PCB).

* * * * *